US006612766B2

(12) United States Patent
Collins

(10) Patent No.: US 6,612,766 B2
(45) Date of Patent: Sep. 2, 2003

(54) WRITING INSTRUMENT

(76) Inventor: Mark G. Collins, 3511 San Jose La., St. Ann, MO (US) 63074

( * ) Notice: Subject to any disclaimer, the term of this patent is extended or adjusted under 35 U.S.C. 154(b) by 0 days.

(21) Appl. No.: 10/010,257

(22) Filed: Dec. 7, 2001

(65) Prior Publication Data

US 2002/0044815 A1 Apr. 18, 2002

Related U.S. Application Data

(63) Continuation-in-part of application No. 09/760,549, filed on Jan. 16, 2001, now abandoned, which is a continuation of application No. 09/219,966, filed on Dec. 23, 1998, now abandoned.

(51) Int. Cl.[7] ..... B43K 29/00
(52) U.S. Cl. ..... 401/88; 401/52; 401/195
(58) Field of Search ..... 401/6, 52, 88, 401/98, 195

(56) References Cited

U.S. PATENT DOCUMENTS

| | | | | |
|---|---|---|---|---|
| 407,374 | A | 7/1889 | Smith | |
| 1,965,068 | A | 7/1934 | Chesler | 40/68 |
| 2,339,514 | A | 1/1944 | Ponath | 40/19 |
| 2,357,940 | A | 9/1944 | Du Lude | 74/128 |
| 2,411,717 | A | 11/1946 | Fay et al. | 35/77 |
| 2,445,170 | A | 7/1948 | Gonczi | 40/108 |
| 2,577,259 | A | 12/1951 | Millington | 40/108 |
| 2,702,439 | A | 2/1955 | Swensson | 40/108 |
| 2,751,700 | A | 6/1956 | Danjczek | 40/68 |
| 3,123,291 | A | 3/1964 | Madry | 235/87 |
| 3,674,905 | A | 7/1972 | Collins, Sr. | 35/35 |
| 4,146,978 | A | 4/1979 | Breslow | 35/77 |
| 4,509,929 | A | 4/1985 | Zawitz | 446/102 |
| 4,928,416 | A | 5/1990 | Penno | 40/618 |
| 4,948,284 | A | 8/1990 | Lingott | 401/195 |
| 4,983,062 | A | 1/1991 | Hour | 401/195 |
| 5,022,774 | A | 6/1991 | Kageyama et al. | 401/52 |
| 5,110,315 | A | 5/1992 | Zawitz | 446/102 |
| 5,172,534 | A | 12/1992 | Milner et al. | 52/593 |
| 5,368,406 | A | 11/1994 | Hanshaw | 401/195 |
| 6,086,445 | A | 7/2000 | Zawitz | 446/146 |

*Primary Examiner*—Gregory L. Huson
*Assistant Examiner*—Peter deVore
(74) *Attorney, Agent, or Firm*—Harness, Dickey & Pierce, P.L.C.

(57) ABSTRACT

A writing instrument having rotatable beads of various shapes and sizes abutting one another so that the beads form logos, designs, words or messages for promotional or advertising purposes. The beads provide an ergonomically pleasing sensation to the user and further provide an element of amusement to the user.

49 Claims, 4 Drawing Sheets

WRITING INSTRUMENT

This application is a continuation-in-part of Ser. No. 09/760,549, filed Jan. 16, 2001, now abandoned, which is a continuation of Ser. No. 09/219,966, filed Dec. 3, 1998 now abandoned.

BACKGROUND OF THE INVENTION

1. Field of the Invention

This invention relates to the field of writing instruments, and more particularly, relates to a writing instrument having beads positioned about the writing instrument for amusement purposes or as an advertising and promotional device.

2. Related Art

Writing instruments, such as pens, are an everyday part of our lives. They remain the most common implements for effecting non-verbal communication. Additionally, writing instruments, such as ball point pens, are frequently utilized in advertising and promotion for businesses. It is believed that several million ballpoint pens are sold each year in the United States alone as promotional give-away items for vendors of various goods and services. Fundraisers of all types, including fundraisers for various educational and religious entities, also utilize the sale of writing utensils to procure funding for various projects. There exists a need to provide a writing instrument, such as a pen or pencil, with a novel means of providing advertising and to promote businesses, groups, ideas, beliefs and displays fanciful messages.

It is well known to provide a writing instrument, such as a pen or pencil, with sleeves or cylindrical members for keeping a calendar. For instance, U.S. Pat. No. 2,445,170 to Gonczi provides a writing instrument having a built-in calendar in a cap, consisting of multiple cylinders on a single axis. The device disclosed by Gonczi records information on interfitting cylinder members and disclosed the information by way of day, month and year (as recorded on separate cylinders) through windows on the outer most cylinder members. However, the Gonczi fountain pen is not adapted to display advertisements or otherwise allow the seller to promote its goods or services or to provide amusement to the user. Moreover, the device disclosed does not allow the seller to provide the writing instrument with various shapes and sizes to aid in promoting the seller's business.

Similarly, U.S. Pat. No. 2,577,259 to Millington and U.S. Pat. No. 2,702,439 to Swenssen disclose devices having calendars on their exterior surfaces and being adapted to hold writing instruments. Like Gonczi, the Millington and Swenssen devices provide cylindrical members, one on top of the other in an interfitting manner, that work in unison to display the day, month and year when the user manipulates the cylinder members into the appropriate positions. As such, these devices are not adapted for, nor do they suggest, advertising or promotion uses. Moreover, both Millington and Swenssen relate to holders of writing utensils where the disclosed devices are fitted over the writing utensil, thus adding additional cost and complexity to the writing instrument itself.

There have been a number of penholder designs employed for the purpose of amusement. For example, U.S. Pat. No. 4,983,062 to Hour relates to a penholder with puzzle blocks whereby a number of blocks with slideable lateral faces are received about a stem that encompasses an ink cartridge. The blocks are arranged such that the user moves the slideable faces between the various rotatable blocks as a puzzle game similar to a RUBICS CUBE®. However, the device disclosed in Hour is relatively complex and costly to manufacture and is not well adapted for use as an advertising or promotional device. Moreover, the Hour device is a penholder, not a writing instrument, again adding to the cost of manufacture by necessitating additional components and assembly expense.

The patent which issued to Du Lude (U.S. Pat. No. 2,357,940) shows a device for counting words and symbols of messages, such as a telegraph message, consisting of a counting mechanism stored in the casing of a writing instrument. The counting mechanism is actuated by depressing the point of the device (i.e, a pen or pencil) adjacent to each word or symbol to be counted and displays the number of words or symbols thus counted through windows on the casing of the device. The Lude device is not, however, intended as an item for advertising and promotion or for amusement of the user. Additionally, the counting mechanism disclosed requires a great deal of space, thus making the device rather unwieldy and uncomfortable to the user.

Accordingly, there exists a need to provide a writing instrument that is adapted for advertising, promotion and amusement, esthetically pleasing, simple and inexpensive to manufacture and ergonomically pleasing to the use.

SUMMARY OF THE INVENTION

In order to overcome the shortcomings of known writing instruments, the present invention has been developed with a number of goals in mind, principal of which is to provide a new and improved writing utensil holder which is rugged and simple in construction, pleasing in appearance and in operation, inexpensive to manufacture and can be used to advertise and promote the goods and services of a vendor and provide amusement to its user.

The present invention provides a writing instrument, which comprises a writing member, a nib socket or writing end, a plurality of rotatable indicia, and an end or aft socket. The indicia, nominally beads, are adapted to rotate about the writing member. Each of the rotatable indicia may be selected from the geometric group consisting of spheres, cylinders, cubes, polyhedrons and other shapes, each having a bore through its center line axis for being received about the center line axis of the writing member. The indicia are nominally decorated on their exterior surface with symbols, lettering or numbering, such that, when arranged together about the writing member, the indicia form a logo, spell words, form symbolic messages or present a purely fanciful display. The decorations on each exterior surface of the indicia may be of a different color, or display a different letter, number or symbol to add to the amusement value of the writing instrument. The indicia also provide a second gripping surface for the writing instrument that is ergonomically pleasing to the user.

The present invention serves the purpose of being a low cost writing instrument which, at the same time, provides advertising, promotion, and identification to the seller and amusement to the user.

Other objects or advantages will be apparent or pointed out in the following description.

BRIEF DESCRIPTION OF THE DRAWINGS

For a better understanding of the present invention, reference should be had to the following detailed description taken in conjunction with the drawings in which.

Corresponding reference characters identify corresponding elements throughout the several views of the drawings.

DETAILED DESCRIPTION OF PREFERRED EMBODIMENTS

Figure 1:
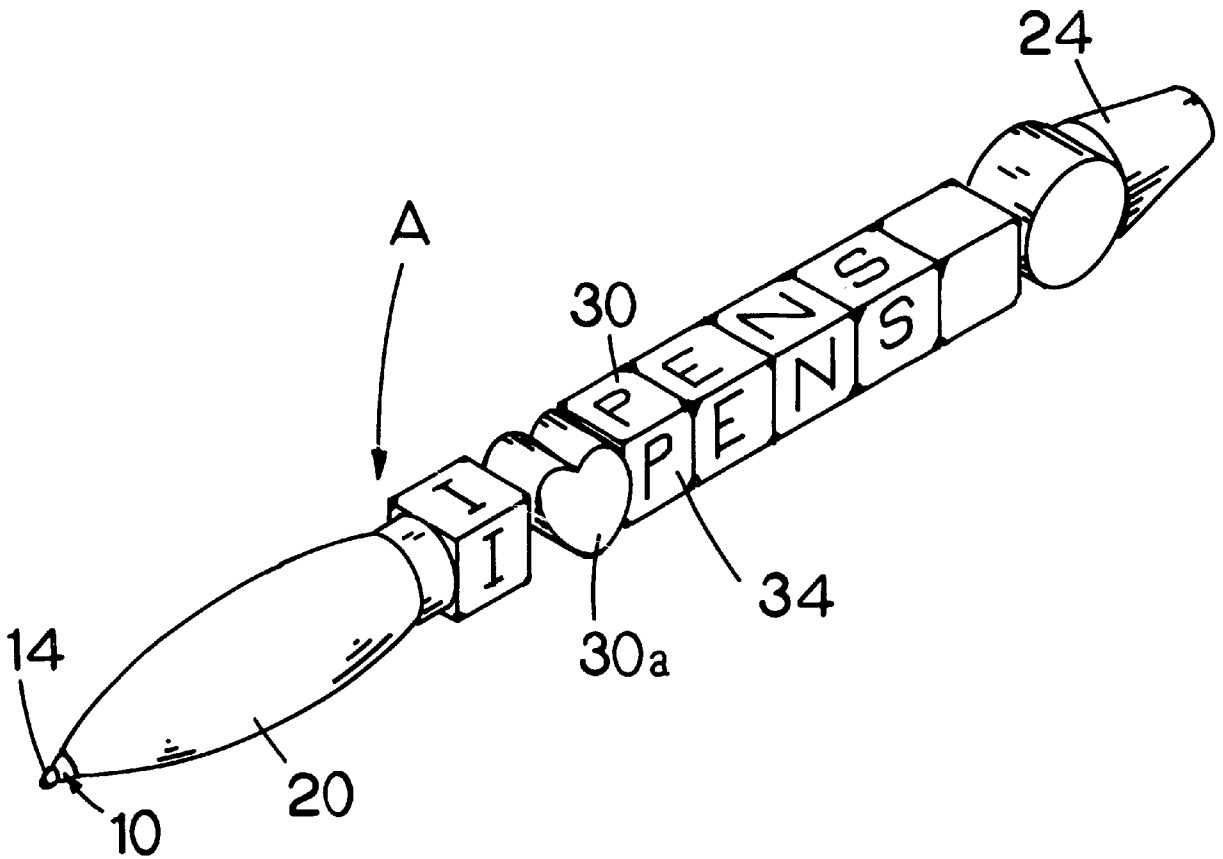
FIG. 1 is a perspective view showing a new and improved writing instrument with indicia according to the invention.
Figure 2:
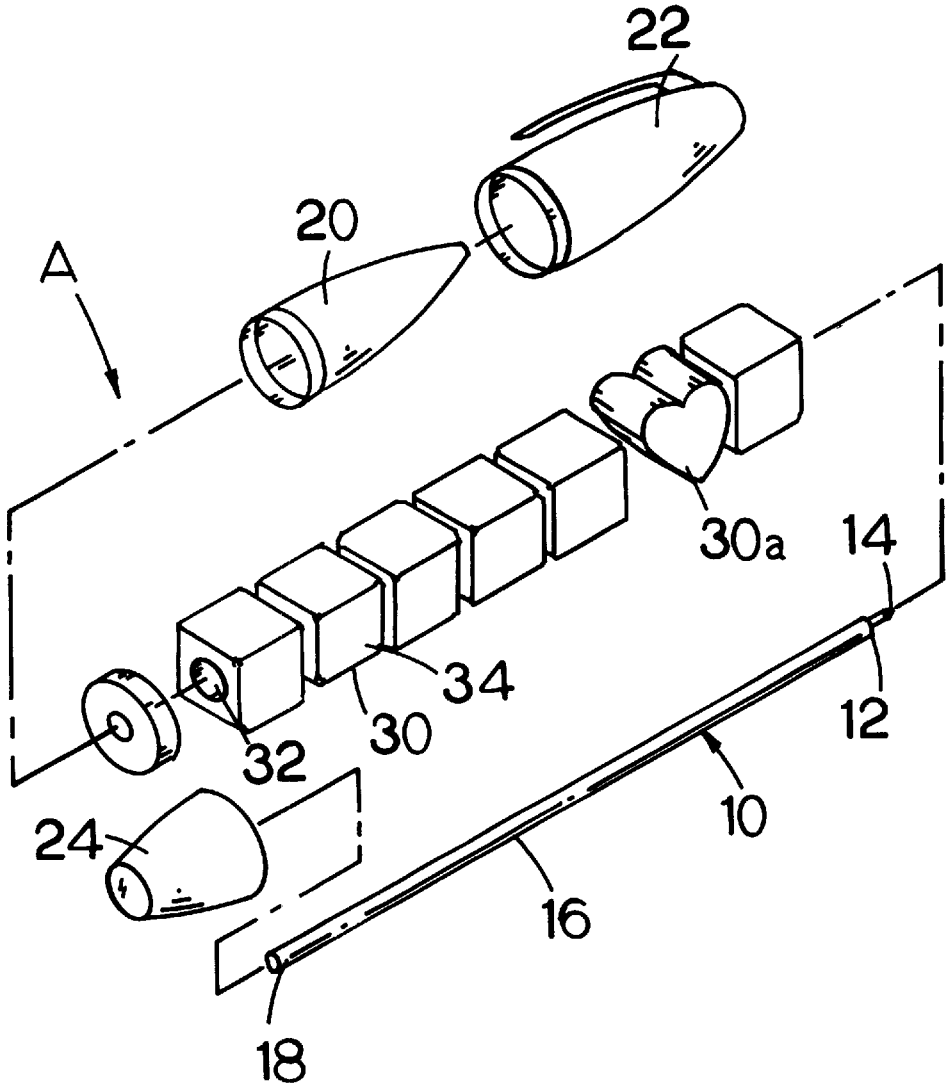
FIG. 2 is an exploded perspective view of the writing instrument with beads shown in FIG. 1.

Referring to FIGS. 1–2 of the drawings, a first embodiment of a writing instrument of the invention is designated A, and includes a writing member 10, a nib socket or front socket 20, a cap or end socket 22, an aft socket 24 and a plurality of rotatable indicia 30.

Figure 4:
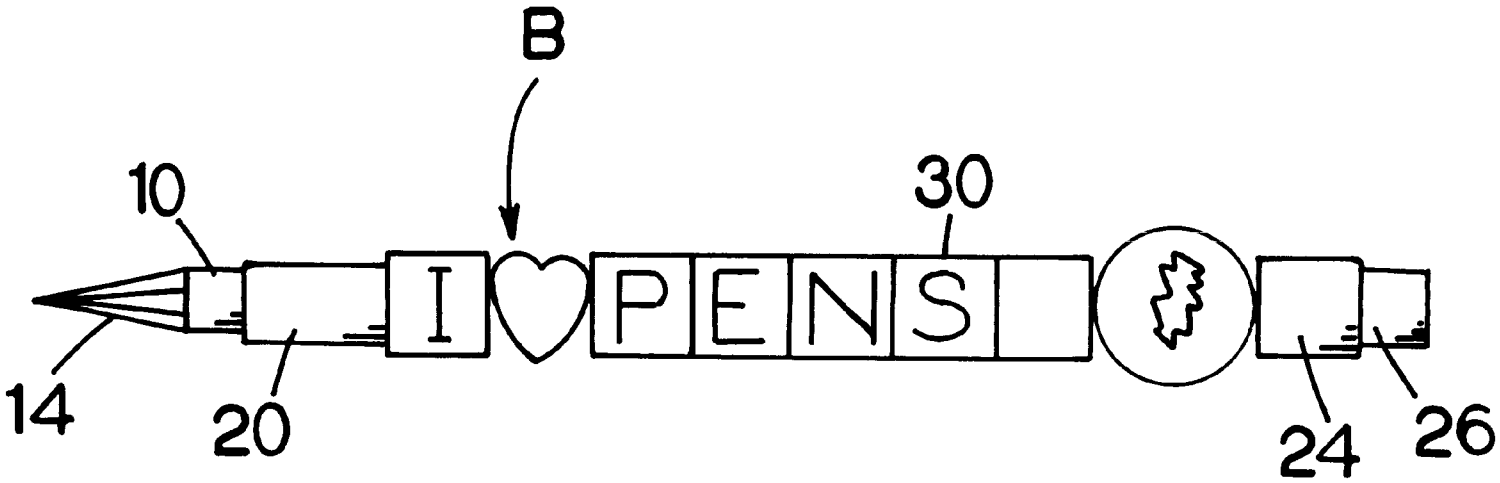
FIG. 4 is a perspective view of a further embodiment of the present invention, utilized as a pencil.

The writing member 10 provides the invention with a means of writing, and can be an ink cartridge, a pencil, a crayon or other writing implement such as a fluorescent marker or the like. In embodiment A of the present invention, writing member 10 is a well-known ballpoint pen having a cylindrical tubular ink reservoir. FIG. 4 shows a second embodiment where the writing member 10 is a pencil.

Indicia 30 are, in essence, bead members of various geometric shapes including spheres, cubes, cylindrical discs, and fanciful shapes including hearts, and well-known shapes of objects such as footballs, basketballs, golfballs and the like. The indicia are preferably made of plastic; however, it will be readily apparent that many other substances with long-wearing properties, such as wood, metal, closed cell foam, ceramics, etc., can be readily substituted. Each of the rotatable indicia 30 is provided with an identical axial through-hole or bore 32 for assembling on the writing member 10 between said nib socket 20 and said aft socket 24, as is more fully discussed below.

As shown in FIG. 1, those indicia 30 shaped as cube have four exterior surfaces, designated 34. It is conceivable that the exterior surfaces 34 of a number of indicia 30 will be provided with letters of the alphabet or numbers arranged to spell a message, theme, or name. It is also envisioned that the exterior surfaces of indicia 30 will have pictorial representations of various animate and inanimate objects, symbols and logos. Similarly, the indicia can be arranged to display a symbolic message. Those indicia of spherical or ovular shape may have disposed about their surface circumference a variety of letters, numbers, symbols, logos, etc.

Nib socket 20 is fitted about the head 12 of writing member 10 and provides an initial gripping surface for the writing instrument A As shown in FIG. 2, end socket 22 is fitted about the nib socket 20 to cover the nib or writing end 14 of writing member 10. A plurality of the rotatable indicia 30 are then fitted about the ink cartridge 16 of writing member 10 in a number so as to sufficiently cover the ink cartridge 16. Aft socket 24 is then fitted to end 18 of writing member 10 so as to fully enclose ink cartridge 16 to prevent accidental blotting or spilling of the ink contained therein. The head 12 of writing member 10 may be smooth (FIG. 2) for a glue or a friction fit with the nib socket 20. Likewise, the end 18 of writing member 10 may be smooth (FIG. 2) for a glue or a friction fit with the aft socket 24.

Indicia 30 can be provided of various sizes depending upon the words, symbol, logo or message to be conveyed. Similarly, a variety indicia 30 with blank exterior surface can be used to act as spacing between multiple words or character symbols. As noted above, certain indicia 30*a* can be fashioned as fanciful shapes, such as hearts, to act as words, namely "love," as shown in FIG. 1. Indicia 30 can also take the form of other well-known shapes, such as footballs, baseballs and golf balls to emphasize a product of the vendor or a theme.

Indicia 30, when arranged about writing member 10, act to form a second gripping surface for the writing instrument A. The shape and size of indicia 30, and their ability to rotate about the writing member 10, provide comfort and an ergonomically pleasing effect to the user. The rotatability of indicia 30 about writing member 10 also provides amusement to the user.

Figure 3:
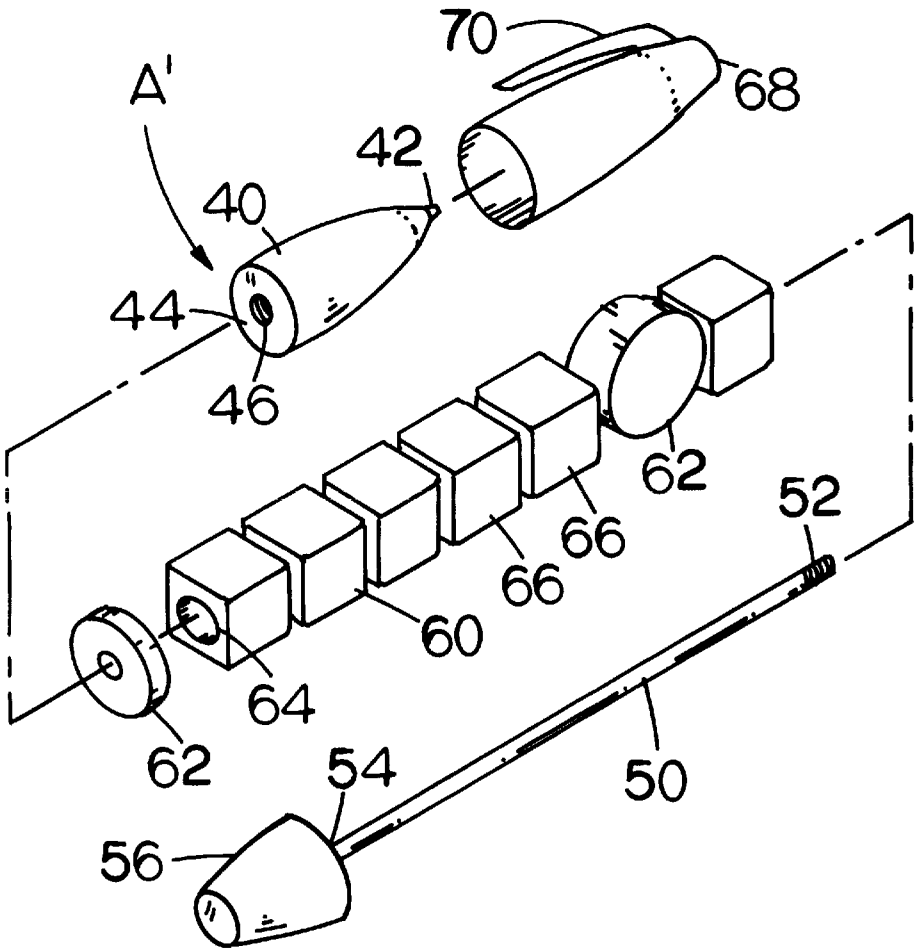
FIG. 3 is an exploded perspective view of a second embodiment of the writing instrument of this invention.

FIG. 3 shows a variation of the writing instrument previously herein described. As shown in this figure, writing instrument A' includes a nib socket 40 having a nib or writing end 42 of an ink cartridge and a flat base section 44. Base section 44 can be provided with a threaded vertical bore 46 which is adapted to threadably engage a threaded rod section 50 as is hereinafter more fully described.

Writing instrument A' also includes a rod section 50 and a plurality of rotatable shaped indicia 60 and 62. Rod section 50 further includes a first threaded end 52, a second threaded end 54 and an aft socket 56. Rotatable indicia 60 and 62 are each provided with a bore 64. Exterior surfaces 66 of indicia 60 and 62 are provided with letters, numbers, or designs as hereinbefore more fully described. Adapted for placement over writing end 42 is cap 68 which may further be provided with a pocket clip member 70. It should be noted that the use of the terms "first" and "second" herein is for identification purposes and not for specifying a particular order or sequence.

Writing instrument A' is assembled by first placing a sufficient number of rotatable indicia 60 and 62 in an arranged design so as to form an appropriate display onto rod section 50 and then threadably engaging threaded end 52 and threaded bore 46 by inserting rod section 50 into base section 44. Although the threaded end 54 may be threadably engaged with a threaded bore (not shown) of the aft socket 56 prior to the placement of the indicia 60 and 62 onto the rod section 50, such is not required. Alternatively, the threaded end 54 may be threadably engaged with the aft socket 56 after the placement of the indicia 60 and 62 onto the rod section 50 and after the engagement of the threaded end 52 with the bore 46. In other embodiments, the rod section 50 may be integral with or fixedly attached to the aft socket 56 thereby eliminating the step of engaging the rod section 50 with the aft socket 56.

There are many variations in the construction of writing instrument A'. For example, the ink cartridge within the nib socket 40 can be adapted to accept ball pen or fountain pen ink and writing end 42 can be a ballpoint or fountain pen nib. Base section bore 46 can be threaded for threadable engagement or smooth for glue or a friction fit insertion of the rod section 50. Similarly, rod section 50 can be plastic, wood or metal.

FIG. 4 shows an alternative embodiment of the present invention, designated as B, where the writing member 10 is a pencil. Nib socket 20 is fitted over writing member 10 near its writing end 14. Indicia 30 are then threaded onto writing instrument 10 from cap end 18 in sufficient number to spell or depict the desired message. Aft socket 24 is then fitted over end 18 (not shown) of writing instrument 10 to retain indicia 30 about writing instrument 10 and, alternatively, to retain an eraser 26.

In view of the foregoing description of the present invention and various embodiments and methods, it will be seen that the several objects of the invention are achieved and other advantages are attained.

The embodiment which has been described in order to best explain the principles of the invention and its practical application to thereby enable others skilled in the arts to best utilize the invention in various embodiments and with various modifications as are suited to the particular use contemplated.

As various modifications could be made in the construction and methods herein described and illustrated without departing from the scope of the invention, it is intended that all matter contained in the foregoing description or shown in the accompanying drawings shall be interpreted as illustrative rather limiting.

What is claimed is:

1. A writing instrument comprising:

an aft socket;

a nib socket;

a writing member having an end and a head, the end adapted to be fitted into the aft socket and the head adapted to be fitted into the nib socket; and one or more rotatable indicia, wherein each indicia is provided with a central bore for placement directly on the writing member fitted between the end and the head.

2. The writing instrument as set forth in claim 1 wherein the head is a nib of the writing instrument.

3. The writing instrument as set forth in claim 1 wherein the nib socket provides an initial gripping surface.

4. The writing instrument as set forth in claim 1 further comprising a cap adapted for placement over the nib socket.

5. The writing instrument as set forth in claim 4 wherein the cap includes a pocket clip member.

6. The writing instrument of claim 1 wherein the shape of the indicia is selected from a group of geometric shapes consisting of spheres, spheroids, cylindrical discs, cubes, and polyhedrons.

7. The writing instrument as set forth in claim 1 wherein the indicia is at least one or more beads.

8. The writing instrument of claim 7 wherein the outer surface of the bead has a type of decoration selected from the group consisting of caricatures, symbols, lettering, and numbering.

9. The writing instrument of claim 1 wherein the aft socket includes an eraser.

10. The writing instrument as set forth in claim 1 wherein the one or more rotatable indicia, when placed onto the writing member, provide a gripping surface for the writing instrument.

11. The writing instrument as set forth in claim 1 wherein at least one of the one or more rotatable indicia comprises a bead element.

12. The writing instrument as set forth in claim 1 wherein at least one of the one or more rotatable indicia comprises a sports ball.

13. The writing instrument as set forth in claim 1 wherein at least one of the one or more rotatable indicia comprises a sports ball selected from the group consisting of footballs, basketballs, baseballs, soccer balls, and golf balls.

14. A writing instrument comprising:

an aft socket;

a nib socket;

a writing member comprising an ink cartridge having an end and a head, the end adapted to be fitted into the aft socket and the head adapted to be fitted into the nib socket; and one or more rotatable indicia, wherein each indicia is provided with a central bore for placement directly on the writing member fitted between the end and the head.

15. A writing instrument comprising:

an aft socket;

a nib socket;

a writing member comprising a pencil having an end and a head, the end adapted to be fitted into the aft socket and the head adapted to be fitted into the nib socket; and one or more rotatable indicia, wherein each indicia is provided with a central bore for placement directly on the writing member portion fitted between the end and the head.

16. A writing instrument comprising:

an aft socket;

a nib socket;

a writing member comprising a marker having an end and a head, the end adapted to be fitted into the aft socket and the head adapted to be fitted into the nib socket; and one or more rotatable indicia, wherein each indicia is provided with a central bore for placement directly on the writing member fitted between the end and the head.

17. A writing instrument comprising:

an aft socket;

a nib socket;

an elongated portion having a uniform shape, the elongated portion having a first threaded end and a second threaded end, the second threaded end adapted to be fitted into a threaded bore in the aft socket and the first threaded end adapted to be fitted into a threaded bore in the nib socket; and a plurality of indicia, wherein each indicia is provided with a central bore for placement on the elongated portion, the indicia being rotatably mounted directly on the elongated portion, the indicia being retained on the elongated portion between the aft socket and the nib socket while the indicia is rotatably mounted directly on the elongated portion.

18. A writing instrument comprising:

a nib socket including a writing member;

an aft socket;

a rod section including a first end engageable with the nib socket and a second end engageable with the aft socket; and one or more indicia rotatably mounted directly on the rod section, the indicia being retained on the rod section between the aft socket and the nib socket while the indicia is rotatably mounted directly on the rod section.

19. The writing instrument as set forth in claim 18 wherein the nib socket provides a gripping surface for the writing instrument.

20. The writing instrument as set forth in claim 18 further comprising a cap adapted for placement over the nib socket.

21. The writing instrument as set forth in claim 20 wherein the cap includes a pocket clip member.

22. The writing instrument as set forth in claim 18 wherein the shape of at least one of the one or more indicia is selected from a group of geometric shapes consisting of spheres, spheroids, cylindrical discs, cubes, and polyhedrons.

23. The writing instrument as set forth in claim 18 wherein at least one of the one or more indicia comprises a bead.

24. The writing instrument as set forth in claim 18 wherein the outer surface of at least one of the one or more indicia is decorated.

25. The writing instrument as set forth in claim 18 wherein the writing member comprises an ink cartridge having a nib.

26. The writing instrument as set forth in claim 25 wherein the nib is a ballpoint pen nib.

27. The writing instrument as set forth in claim 25 wherein the nib is a fountain pen nib.

28. The writing instrument as set forth in claim 18 wherein at least a portion of the first end of the rod section is threaded, and wherein the nib socket is threadedly engageable with the threaded portion of the first end of the rod section.

29. The writing instrument as set forth in claim 18 wherein the nib socket is removably attached to first end of the rod section.

30. The writing instrument as set forth in claim 18 wherein the aft socket is removeably attached to the second end of the rod section.

31. The writing instrument as set forth in claim 18 wherein the one or more indicia, when placed onto the writing member, provide a gripping surface for the writing instrument.

32. The writing instrument as set forth in claim 18 wherein at least one of the one or more indicia comprises a fanciful shape.

33. The writing instrument as set forth in claim 18 wherein at least a portion of the second end is threaded, and wherein the aft socket is threadedly engageable with the threaded portion of the second end of the rod section.

34. The writing instrument as set forth in claim 18 wherein at least one of the one or more indicia comprises a bead element.

35. The writing instrument as set forth in claim 18 wherein at least one of the one or more rotatable indicia comprises a sports ball.

36. The writing instrument as set forth in claim 18 wherein at least one of the one or more rotatable indicia comprises a sports ball selected from the group consisting of footballs, basketballs, baseballs, soccer balls, and golf balls.

37. The writing instrument as set forth in claim 18 wherein each of the one or more indicia includes a bore therethrough for placement on the rod section.

38. A writing instrument comprising:

a rod section including a first end and a second end, at least a portion of the first end being threaded;

a nib socket including a writing member, the nib socket being threadedly engageable with the threaded portion of the first end of the rod section;

aft socket engaged with the second end of the rod section; and one or more indicia rotatably mounted directly on the rod section, the indicia being retained on the rod section between the aft socket and the nib socket while the indicia is rotatably mounted directly on the rod section.

39. The writing instrument as set forth in claim 38 wherein at least a portion of the second end is threaded, and wherein the aft socket is threadedly engageable with the threaded portion of the second end of the rod section.

40. The writing instrument as set forth in claim 38 wherein at least one of the one or more indicia comprises a bead element.

41. The writing instrument as set forth in claim 38 wherein at least one of the one or more rotatable indicia comprises a sports ball.

42. The writing instrument as set forth in claim 38 wherein at least one of the one or more rotatable indicia comprises a sports ball selected from the group consisting of footballs, basketballs, baseballs, soccer balls, and golf balls.

43. The writing instrument as set forth in claim 38 wherein the shape of at least one of the one or more indicia is selected from a group of geometric shapes consisting of spheres, spheroids, cylindrical discs, cubes, and polyhedrons.

44. The writing instrument of claim 38 wherein each of the one or more indicia includes a bore therethrough for placement on the rod section.

45. A method for assembling a writing instrument comprising:

rotatably mounting one or more indicia directly on a writing member between a head of the writing member and an end of the writing member;

engaging the end of the writing member with an aft socket; and engaging the head of the writing member with a nib socket.

46. A method for assembling a writing instrument, comprising:

rotatably mounting one or more indicia on a rod section including a first end and a second end;

engaging the second end of the rod section with an aft socket; and engaging the first end of the rod section with a nib socket, the nib socket containing a writing member;

the indicia being retained on the rod section between the aft socket and the nib socket while the indicia is rotatably mounted directly on the rod section.

47. The method as set forth in claim 46 wherein engaging the second end of the rod section with the aft socket comprises threadedly engaging the second end of the rod section with the aft socket.

48. The method as set forth in claim 46 wherein engaging the first end of the rod section with the nib socket comprises threadedly engaging the first end of the rod section with the nib socket.

49. A writing instrument comprising:

means for writing;

means for displaying indicia; and means for rotatably supporting and retaining the means for displaying indicia relative to the means for writing.

* * * * *

UNITED STATES PATENT AND TRADEMARK OFFICE

CERTIFICATE OF CORRECTION

PATENT NO. : 6,612,766 B2
DATED : September 2, 2003
INVENTOR(S) : Mark G. Collins It is certified that error appears in the above-identified patent and that said Letters Patent is hereby corrected as shown below:

Column 3,
Line 52, insert a period between “Writing Instrument A” and “As shown”.

Column 7,
Line 52, insert -- an -- before “aft socket”.

Signed and Sealed this

Twentieth Day of April, 2004

JON W. DUDAS
*Acting Director of the United States Patent and Trademark Office*